United States Patent [19]

Merrill, Jr.

[11] 4,341,620

[45] Jul. 27, 1982

[54] METHOD AND APPARATUS FOR PROCESSING OIL SHALE IN A ROTARY HEARTH

[75] Inventor: LaVaun S. Merrill, Jr., Englewood, Colo.

[73] Assignee: Marathon Oil Company, Findlay, Ohio

[21] Appl. No.: 232,944

[22] Filed: Jan. 8, 1981

Related U.S. Application Data

[63] Continuation of Ser. No. 2,413, Jan. 10, 1979, abandoned.

[51] Int. Cl.[3] ..... C10G 1/02; C10B 1/06

[52] U.S. Cl. ..... 208/11 R; 202/117; 202/137

[58] Field of Search ..... 208/11 R; 202/117, 137

[56] References Cited

U.S. PATENT DOCUMENTS

| | | | |
|---|---|---|---|
| 2,723,226 | 11/1955 | Tesher | 202/226 |
| 3,470,068 | 9/1969 | Kemmerer et al. | 202/117 |
| 3,496,094 | 2/1970 | Smith | 208/11 R |
| 3,594,286 | 7/1971 | Kemmerer | 202/117 |
| 3,998,703 | 12/1976 | Harrell | 202/133 |

*Primary Examiner*—T. M. Tufariello

*Attorney, Agent, or Firm*—Jack L. Hummel

[57] ABSTRACT

Hydrocarbon containing oil shale is processed on the surface of a rabbled rotary hearth by mixing it with a heat exchange medium consisting of heated spent oil shale. Mixing is obtained by feeding the raw shale and the heated spent shale separately, but in proximity to one another, onto the surface of a hearth, and then subjecting both materials to rabbling action. This mixing causes heat from the heated spent shale heat exchange medium to be transferred to the fresh raw shale, which results in the removal of hydrocarbons from the raw shale. In one preferred embodiment, heated spent shale is obtained by removing spent shale from the hearth after processing, mixing it, preferably while it is still hot, with compatible combustible solids, and then introducing oxidizing gases into the mixture. This results in the burning of the combustible solids and any combustible materials remaining in the shale and the heating of the spent shale.

13 Claims, 2 Drawing Figures

METHOD AND APPARATUS FOR PROCESSING OIL SHALE IN A ROTARY HEARTH

This is a continuation of our co-pending application Ser. No. 2,413, filed Jan. 10, 1979, now abandoned.

BACKGROUND OF THE INVENTION

1. Field of the Invention

This invention relates to processes and apparatus for producing hydrocarbon products from oil shale in a rotary hearth. In preferred embodiments this invention pertains to systems for obtaining hydrocarbons from oil shale in a rabbled rotary hearth using heated spent oil shale as a heat exchange medium. In one embodiment the spent oil shale is heated with compatible combustible solids, such as coal char.

2. Prior Art

Oil shale contains hydrocarbons which can be recovered in the form of kerogen and volatile gases. These hydrocarbons are removed from the shale by subjecting the shale to heating and retorting. As the supply of naturally occurring accessible liquid and gaseous hydrocarbons diminishes, it is becomming necessary to rely either upon more and more foreign produced hydrocarbons, or to find sound economical methods of obtaining hydrocarbons from other resources. The most abundantly available hydrocarbon resource is oil shale.

Many systems, including some using a heat exchange medium, have been proposed for use in the recovery of hydrocarbons from oil shale. In one system oil shale in the form of fines is passed through a fluidized bed and heated to drive off hydrocarbons. However, such systems are inefficient, yielding only a relatively small percentage of hydrocarbons from the shale, and some of the hydrocarbons which are derived being subjected to cracking which produces less desirable hydrocarbons. In another system, solid oil shale is dropped into the top of a vertical retort through which hot gases are passed. This causes oil and volatile gases to be driven from the oil shale as it passes downward through the retort. While this technique can provide substantially complete removal of hydrocarbons from the shale, it again results in some cracking in the retort of the hydrocarbons removed from the shale.

In other prior art heat transfer systems, heat is transferred to particulate oil shale from a heated inert material, such as hot steel balls, sand or quartz. While this provides a fairly efficient method of heat transfer, it also requires separation of the heated inert material from the spent oil shale for further use of the inert material as a heat exchange medium.

In several systems a rotary kiln, has been utilized to process oil shale or coking coal with heat transfer from spent shale or coal. For example, in U.S. Pat. No. 2,723,226 a stream of fine sized coking coal or oil shale is projected into a mass of previously heated coke or char fines in a mixing screw and the mixture then projected into a revolving rotary retort kiln. This system requires both that the starting raw material be of substantially fine size, and further requires that careful and complex valving control and a separate mixing screw device be used in order to control feeding the fines into the rotating kiln. In U.S. Pat. No. 3,496,094 raw oil shale is mixed with hot solid spent oil shale in a rotating kiln in which the kiln includes baffles oriented to cause the solids to mix. The spent oil shale is preheated utilizing expensive volatile hydrocarbons.

BRIEF DESCRIPTION OF THE INVENTION

With the above in mind, it is the main object of the present invention to provide a system whereby hydrocarbon containing oil shale is processed on the surface of a rabbled rotary hearth by mixing it with a heat exchange medium consisting of heated spent oil shale. This is accomplished, generally in a rotary hearth having at least one point for the admission to the floor of the hearth of to-be-treated oil shale and a radially closely adjacent point for the admission of heated heat exchange medium. Rabbles disposed above the floor of the hearth and capable of relative rotary movement with respect to the hearth are spaced radially across the hearth. During relative rotary motion, the rabbles mix the to-be-treated oil shale and the heated heat exchange medium. This mixing causes heat from the heat exchange medium to be efficientlly transferred to the bulk of hydrocarbon containing oil shale, which in turn results in the removal of volatile hydrocarbons from the oil shale. The volatile hydorcarbons are quickly removed from the heated hearth area and then processed to produce shale oil and hydrocarbon gases.

Using this system, substantially all of the hydrocarbons are removed from the oil shale, and because of the limited time during which the volatiles are exposed to high heat, little cracking of the hydrocarbons is experienced.

During relative rotary motion between the hearth and rabbles, the rabbles in the system continuously mix and stir the material on the hearth. This assures substantially uniform heat transfer and substantially complete removal of hydrocarbons from the oil shale. Relative rotary motion between the hearth and rabbles also causes movement of the materials from their points of entry to a discharge point. Materials which are discharged retain a great deal of their processing heat, but they have had substantially all of their hydrocarbon materials driven from them, and are therefore designated as "spent oil shale." In the process of the present invention substantial quantities of spent oil shale material are heated and returned to the hearth to serve as a heat exchange medium with fresh oil shale. There is, of course, no need to separate heat exchange medium from the spent oil shale, as they are substantially one and the same material.

In one preferred embodiment, the spent oil shale is heated with compatible combustible solid materials. After mixing such materials with the spent shale the solid combustible materials are oxidized or burnt to heat the spent oil shale prior to returning it to the hearth for use as a heat exchange medium.

These and other aspects and advantages of the present invention are apparent in the following detailed description and claims, especially when read in conjunction with the accompanying drawings in which like parts bear like reference numerals.

DESCRIPTION OF THE PREFERRED EMBODIMENTS

Oil Shale Processing System

Figure 2:
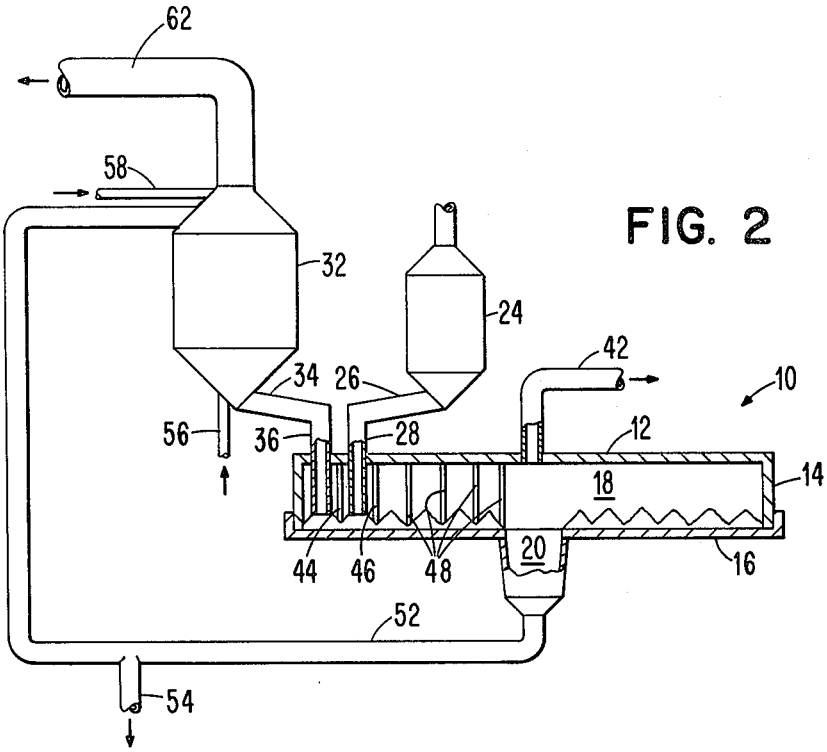
FIG. 2 is an elevation through section 2—2 of the rotary hearth of FIG. 1, diagrammatically showing the relationship between the hearth and the flow of materials to and from the hearth.
Figure 1:
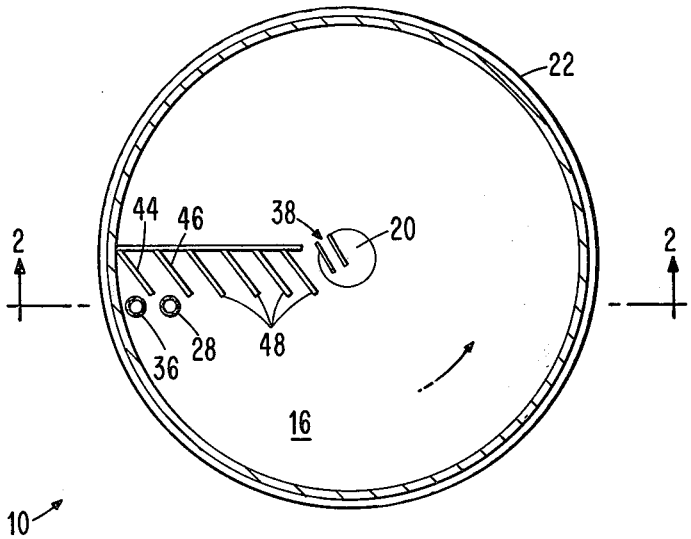
FIG. 1 is a diagrammatical representation of a rotary hearth according to the present invention.

Referring to FIGS. 1 and 2, a hearth system 10 having a roof 12, sidewalls 14, and rotary hearth 16, defines toroidal heating chamber 18. Hearth 16 is generally round and includes central opening 20 and peripheral edge 22. Oil shale feed bin 24 is located outside of the hearth system and is connected by means of tube 26 to chute 28 located within the oven. The bottom of chute 28 is located above hearth 16 to deliver fresh oil shale material to the hearth for devolatilizing treatment. Combined heating and feed bin 32 is also located outside of hearth 10 and is connected by means of tube 34 to chute 36 located within the hearth. The bottom of chute 36 is also located above the hearth to deliver heated spent oil shale heat exchange medium to the hearth. Central discharge outlet 38 serves as a discharge outlet from the hearth. This outlet is provided in the system to allow removal of spent oil shale and heat exchange medium from the hearth. Vent 42 located above hearth 10 is provided to vent volatile materials and vapors removed from the oil shale.

Rabbles are suspended from roof 12 of the hearth system. Rabbles 44 and 46 serve to mix and urge newly delivered materials towards the center of the hearth, in response to rotation of the hearth in a counter-clockwise direction as indicated by the arrow in FIG. 1. Rabbles 48 are also present in the system. As is art known, each rabble 44, 46, and 48 has an active face, not shown which is oriented to contact and progressively move and mix material on the hearth. Rabbles 44, 46, and 48 are oriented with their active faces at an angle to the radius of the hearth so as to mix and move material with which they come in contact during relative rotary motion progressively towards the center of the hearth. The location and structure of peripheral discharge outlet 38 is such that it plows material off of the hearth and into central opening 20, which leads to means 52 which conveys the spent oil shale material to heating and feed bin 32. Excess spent oil shale may be removed from further processing at outlet 54. Also entering heating bin 32, in addition to spent oil shale, is oxidizing gas, such as air, by means of inlet 56 and combustible solid material by means of inlet 58. Combustion gases and vapor produced during burning in bin 32 are allowed to exit by means of flue 62. Additional details of the system and its operation on to-be-treated oil shale are set forth below.

Operation of the System

Referring again to FIGS. 1 and 2, the operation of hearth 10 in the processing of oil shale, for example, is now described in detail. Spent oil shale in bin 32 is preheated to a temperature in the range of about 900° F. to about 1500° F. (482° C. to about 816°C.), and preferably from about 1300° F. to about 1400° F. (704°C. to about 760°C.). The thus heated spent oil shale is then fed from bin 32 through tube 34 into feed chute 36. At the same time, counter-clockwise rotation is initiated in hearth 16 by art known means, not shown, and fresh crushed oil shale is fed from bin 24 through tube 26 into feed chute 28 and onto rotating hearth 16. Initially, materials fed from feed chutes 28 and 36 provide adjacent concentric circumferential bands of raw oil shale and heated heat exchange material on the hearth. In the structure shown, rabbles 44 and 46 are upstream of chutes 36 and 28, respectively. After one nearly complete revolution of hearth 16, crushed oil shale from chute 28 is moved into contact with rabble 46 and heated spent oil shale heat exchange material deposited from chute 36 is moved into contact with rabble 44. Both materials build up against the active face of the respective rabbles, moving primarily centerward, but outward to some extent, and the heated heat exchange material and crushed oil shale begin to mix. As the hearth continues to rotate in a counter-clockwise direction as indicated by the arrow on FIG. 1, after one complete additional revolution the heated heat exchange material contacts and then begins to build up against the leading or active face of rabble 46, and is further mixed with oil shale deposited by chute 28. Subsequently, as oil shale and heat exchange material pile up against the active faces of each rabble, mixing continues and a portion of the mixed materials spills off towards the center at the back or trailing edge of each rabble, thus forming windrows. These windrows are carried around by the continued rotation of hearth 16 until they come into contact with the next radially inward adjacent rabble 48. This process is repeated progressively until the materials reach central discharge outlet 38. Then additional rotation of the hearth forces the material radially inwardly of discharge opening 38 and out of the hearth at central opening 20.

As it exits the now spent oil shale and slightly cooled heat exchange medium exhibit a combined temperature in the range of about 900° F. to about 1050° F. (482° C. to about 565° C.). While still hot they are recycled, by means of feed 52 back to heating and feed bin 32. As a portion of the spent oil shale may not be needed it can be removed from the system at opening 54, and, for example, fed to a recuperating device for use as a heat exchange material, for example, to preheat oxidizing gases or raw oil shale.

Oxidizing gases, such as air, are inserted into heating bin 32, for example, through inlet 56. Combustible materials are also inserted into bin 32 to heat the spent oil shale. Where the combustible materials are volatile gases, they may be inserted into bin 32 through inlet means, not shown, in stoichiometric quantities to heat the spent oil shale. However, in preferred embodiments, solid compatible combustible materials, such as coal char, are caused to enter bin 32 by means of inlet 58. The solid combustible materials and spent oil shale entering bin 32 mix fairly uniformly throughout the bin due to their natural falling and tumbling action. The combustible solid materials are ignited due to the retained heat of spent oil shale and the action of the oxidizing gases. The heat thus generated by the burning solid combustible materials heats the spent oil shale to a temperature at which it is again an effective heat exchange medium for use within the rotary hearth system.

EXAMPLE

Raw hydrocarbon containing oil shale assaying about 30 gallons (114 liters) of oil per ton (0.9 metric ton) is crushed, for ease of processing, to pieces in the range of about ¼ to about ½ inch (about 0.6 to about 1.2 cm). The crushed oil shale is fed to a rotary hearth system of the type detailed above in the present invention and having a diameter of about 55 feet (16.7 m). Spent oil shale heat exchange medium heated to about 1500° F. (816°C.) is simultaneously fed to the rotary hearth in proximity to the raw oil shale in a weight ratio of about two parts of heat exchange medium for each one part of raw oil shale. Relative rotary motion between the hearth and rabbles causes the raw oil shale and the heated spent oil shale to mix and to move slowly across the hearth towards a discharge port. During this mixing and moving, a portion of the heat carried by the heated spent oil shale is transferred to or exchanged with the raw oil shale, thus raising the raw oil shale to a temperature at which the volatile hydrocarbons within the oil shale are driven from the shale. The volatile hydrocarbons are then quickly removed from the hearth system before there is an opportunity for them to be cracked. Upon being collected and condensed the volatile vapors produced in the hearth system by this process are found to provide a good grade of shale oil, with only small amounts of low molecular weight products.

In this example no other source of heat for the oil shale is required to release substantially all of the volatile hydrocarbons from the raw oil shale. The dimensions of the hearth, the location and orientation of the rabbles, and the speed of rotation of the hearth are such that materials undergoing treatment have an average residence time in the hearth of only about 15 minutes. On exiting from the hearth, the material, which is now all spent oil shale, retains a temperature in the range of about 1000° F. (about 540°C.). Thus, when it is recycled and heated, it rquires only a small amount of energy input, preferably from compatible combustible solids, to return it to a temperature of about 1500° F. (816°C.).

At full capacity, this exemplary system is capable of processing in this manner about 266 tons (about 242 metric tons) of material per hour, which, at a ratio of $\frac{1}{3}$ fresh oil shale to $\frac{2}{3}$ heat exchange medium, would process about 89 tons (about 80 metric tons) of fresh oil shale per hour. Utilizing oil shale which assays at about 30 gallons (114 liters) of oil per tone (0.9 metric ton) about 63 barrels of 42 gallons (about 160 liters) each of shale oil is produced per hour. This amounts to about 1500 barrels of shale oil every 24 hours per hearth.

While the present invention has been disclosed as depositing hydrocarbon containing oil shale and heated heat exchange material closely adjacent one another at the periphery of a hearth, it can easily be modified to deliver the materials elsewhere, such as near the center of the hearth, and feed them towards the periphery of the hearth during processing. It is equally within the skill of the art to utilize a plurality of raw oil shale feeds or heat exchange materials feeds to the hearth.

Other modifications to the system are contemplated. For example, while means 52 has been shown as a chute for feeding spent oil shale material to bin 32, thus requiring art known pneumatic means to move the material, other equivalent means, such as conveyors, can be utlized for the same purpose.

It has been indicated, that in preferred embodiments, coal char is utilized as the compatible combustible solid material which is burnt in bin 32 in the presence of oxidizing gases to heat the spent oil shale. However, other compatible solid combustible materials which do not leave residues or by-products which hamper the use of the spent oil shale as a heat exchange material, include, but are not limited to, wood char, lignite, anthracite coal, petroleum coke, wood, or even raw oil shale or other equivalent materials. Again, in nonpreferred embodiments, combustible gases can be utilized for the same purpose. In any such heating of spent oil shale in the presence of oxidizing gases nonvolatile combustible organic or carbonaceous materials remaining in the spent oil shale after heating on the rotary hearth are ignited in bin 32 and assist in heating the spent oil shale to the temperature required for its use as a heat exchange medium.

It should be noted that in the preferred practice of the present invention, when compatible combustible solid materials are utilized to heat the spent oil shale, a very small amount of inexpensive combustible material is capable of producing the temperature required in the heat exchange medium. For example, solid combustible coal char material having a weight in the range of as little as about 1% to about 3% of the to-be-heated spent oil shale is sufficient to obtain the temperatures reqired for the use of the material as a heated heat exchange material.

While a ratio of two parts by weight of spent oil shale to one part of fresh oil shale has been set forth in the above example, and is the preferred ratio, other ratios of heat exchange material to raw oil shale can be successfully utilized in the practice of the present invention. For example, ratios of as little as one part of heat exchange material to about one part of raw oil shale, to as much as nine parts of heat exchange material to one part of raw oil shale can be utilized in the practice of the present invention. Generally, the ratio of fresh shale to heat exchange material depends upon several factors, including the temperature of the heat exchange material and the residence time of the materials within the hearth system.

Generally it is desirable, but not mandatory, that the temperature of the heat exchange material not exceed about 1500° F. (816° C.). Above that temperature carbonates in the oil shale tend to calcine so that the heat energy is wasted in a calcination reaction. The temperature provided to the hearth by the heat exchange medium during devolatilization may vary from about 900° F. to about 1500° F. (about 480° C. to about 816° C.) with temperatures in the range of about 1300° F. to about 1450° F. (about 700° C. to about 785° C.) being preferred.

In some instances it may be desirable or necessary to add heat to the hearth during processing. This can be accomplished either by the use of external heating equipment, which is art known, or by the controlled ignition of a portion of the volatiles within the hearth. The latter is not considered desirable as it results in a loss of desirable hydrocarbon products and encourages cracking of the hydrocarbon materials in the hearth. In preferred embodiments oxidizing gases are not present in the hearth during devolatilization.

As has been previously noted, after removal from the hearth, the heat energy present in the spent oil shale which is not heated for utilization as heat exchange media and the heat present in the to-be-cooled volatile hydrocarbon products can be efficiently utilized for many purposes including the preheating of either the oxidizing gases prior to their introduction into heating bin 32 or the heating of the raw oil shale prior to its entry onto the hearth. Heat released through flue 62 connected to heating bin 32 can also be utilized in a similar manner. Heating of the raw oil shale above ambient temperature may be useful so long as it is not heated to a temperature which will result in the premature release of its volatile hydrocarbon components.

As utilized herein, the term "raw oil shale" or "oil shale" refers to a complex mixture containing volatile hydrocarbons and other organic and mineral materials in the form of shale. "Spent oil shale" refers to the same material after it has had substantially all of its volatile hydrocarbon materials removed.

The practice of the present invention provides a useful and simple means of extracting volatile hydrocarbons from oil shale quickly, efficiently, and with a minimum of cracking of the hydrocarbons. It is also mechanically efficient, and although the oil shale is ultimately reduced to fine particle size during the process, the process is substantially dust free and requires no special apparatus such as cyclone separators to control, filter, or remove the fines. The operation is also cleaner and more dust free than the operation of a rotary kiln since a hearth can be sealed more tightly than a kiln.

While the foregoing preferred embodiment of the invention has been described and shown, it is understood that alterations and modifications, such as those suggested, and others, may be made thereto, and fall within the scope of the invention as claimed.

What is claimed is:

1. A process for recovering volatile hydrocarbons and hydrocarbon-containing oil shale including steps of:

(1) supplying hydrocarbon-containing oil shale to the floor of a rabbled rotary hearth in a chamber;

(2) supplying at least an equal weight proportion of heated spent oil shale heat exchange medium to the floor of said hearth in close radial proximity to the said hydrocarbon-containing oil shale;

(3) mixing said hydrocarbon-containing oil shale and said heat exchange medium by means of relative rotary motion between said hearth and said rabbles, whereby heat is exchanged from the heat exchange medium to the hydrocarbon-containing oil shale to drive volatile hydrocarbons from said shale and leave spent oil shale;

(4) quickly removing said volatile hydrocarbons from said chamber; and (5) recycling at least a portion of said spent oil shale produced from step 3 to a heating zone wherein the spent shale is heated to obtain heated spent oil shale exchange medium and then introducing said exchange medium to the floor of the hearth via step 2.

2. The process of claim 1 wherein oxidizing gases and combustible materials are mixed with said spent oil shale before it is recycled to the floor of the hearth and the combustible materials are ignited thereby causing the spent oil shale to be heated.

3. The process of claim 2 wherein the spent oil shale is heated to a temperature in the range of about 480° C. to about 816° C. before it is recycled to the floor of the hearth.

4. The process of claim 2 wherein the spent oil shale is heated to a temperature in the range of about 700° C. to about 785° C. before it is recycled to the floor of the hearth.

5. The method of claim 2 wherein the combustible material is solid and is selected from the group consisting of coal char, wood char, lignite, anthracite coal, petroleum coke, wood, and raw oil shale.

6. The method of claim 5 wherein the weight per cent of combustible solid material to spent oil shale zone is in the range of about 1% to about 3%.

7. The method of claim 1 wherein the weight ratio of hydrocarbon-containing oil shale to heated spent oil shale is in the range of about 1:1 to about 1:9.

8. The method of claim 1 wherein the weight ratio of hydrocarbon-containing oil shale to heated spent oil shale is in the range of about 1:2.

9. A system for deriving volatile hydrocarbons from hydrocarbon-containing oil shale material comprising:

a chamber including a roof and sidewalls;

a substantially round hearth within said chamber, said hearth having discharge means;

a plurality of substantially stationary rabbles located within said hearth, said rabbles disposed above, but adjacent to said hearth;

a means for providing relative rotary motion between said hearth and said rabbles, wherein said rabbles are oriented and located to both mix any hydrocarbon-containing oil shale disposed on said hearth at a first location on said hearth with any heated spent oil shale heat exchange medium disposed on said hearth at a second location on said hearth, and to also cause any such materials to traverse from their areas of initial deposit to said discharge means;

a first supply means for supplying hydrocarbon-containing oil shale to said hearth at a first location on said hearth;

a means for heating spent oil shale to a temperature of from about 482° C. to about 816° C.;

a second supply means for supplying heated spent oil shale heat exchange medium to said hearth at a second location on said hearth, said second location being in close radial proximity to said first location;

a means for collecting spent oil shale discharged from said hearth at said discharge means;

a means for recycling spent oil shale from said discharge means to said second supply means through said means for heating spent oil shale; and a means for collecting volatile hydrocarbons which are evolved from said hydrocarbon-containing oil shale.

10. The system of claim 9 wherein the said means for heating said spent oil shale includes an inlet for oxidizing gases and means for supplying combustible materials to said heating means.

11. The system of claim 10 wherein said heating means has an upper portion above any to-be-heated spent oil shale, and wherein said means for supplying combustible materials to said heating means is located at said upper portion.

12. The system of claim 9 wherein said collecting means is pneumatic.

13. The system of claim 9 wherein said collecting means is a conveyor system.

* * * * *

UNITED STATES PATENT AND TRADEMARK OFFICE

CERTIFICATE OF CORRECTION

PATENT NO. : 4,341,620

DATED : July 27, 1982

INVENTOR(S) : LaVaun S. Merrill, Jr.

It is certified that error appears in the above-identified patent and that said Letters Patent are hereby corrected as shown below:

Col. 1, line 53: Delete ",".
Col. 2, line 22: Delete "hydorcarbons" and insert --hydrocarbons--.
Col. 5, lines 53-54: Delete "utlized" and insert --utilized--.
Col. 7, line 21: Delete "and" and insert --from--.
Col. 8, line 2: Delete "zone".

Signed and Sealed this

*Fifth* Day of *October 1982*

[SEAL]

*Attest:*

GERALD J. MOSSINGHOFF

*Attesting Officer*

*Commissioner of Patents and Trademarks*